US007044858B1

(12) United States Patent
Otto et al.

(10) Patent No.: US 7,044,858 B1
(45) Date of Patent: May 16, 2006

(54) VARIABLE WEIGHT EXPANDABLE BATON

(75) Inventors: Kevin L. Otto, Milwaukee, WI (US); Robert W. Boxer, Bayside, WI (US); Aaron J. Dexter, Milwaukee, WI (US)

(73) Assignee: Enforcement Technology Group Inc., Milwaukee, WI (US)

( * ) Notice: Subject to any disclaimer, the term of this patent is extended or adjusted under 35 U.S.C. 154(b) by 0 days.

(21) Appl. No.: 11/033,857

(22) Filed: Jan. 12, 2005

(51) Int. Cl.
*F41B 15/02* (2006.01)

(52) U.S. Cl. ..... 463/47.2; 463/47.7

(58) Field of Classification Search ..... 463/47.2, 463/47.4, 47.7; 273/334, 559, 564
See application file for complete search history.

(56) References Cited

U.S. PATENT DOCUMENTS 3,116,926 A * 1/1964 Owen et al. ..... 473/457
5,016,148 A 5/1991 Kohm
5,192,075 A * 3/1993 Ashihara ..... 463/47.4
5,356,139 A 10/1994 Parsons
5,873,783 A 2/1999 McBain et al.
6,056,643 A 5/2000 Wilmoth, III
6,135,888 A 10/2000 Hindi
6,306,040 B1 * 10/2001 Chang ..... 463/47.7
6,379,286 B1 4/2002 Scopino et al.
6,682,447 B1 * 1/2004 Black ..... 473/457

* cited by examiner

*Primary Examiner*—William Pierce

(57) ABSTRACT

A self defense tool includes a tubular body provided with an axial bore and a removable closed handle end opposite a removable closed striking end. A variable weight holding arrangement is positioned inside the axial bore of the body between the handle and striking ends and is engageable with the striking end. The holding arrangement is adapted to retain at least one weight member inside the axial bore to selectively enable changing weight of the tool. The variable weight holding arrangement includes a stop disposed in the axial bore of the body, and a coil spring inserted in the axial bore and extending between the stop and striking end. The at least one weight member is adapted to be received in the axial bore and held between the spring and the striking end.

16 Claims, 3 Drawing Sheets

VARIABLE WEIGHT EXPANDABLE BATON

FIELD OF THE INVENTION

The present invention relates generally to expandable batons or night sticks employed by law enforcement personnel. More particularly, the present invention pertains to a three section, telescopic baton having a variable weight feature.

BACKGROUND OF THE INVENTION

Expandable batons have been used for many years by law enforcement officers as a convenient alternative to conventional one-piece batons or night sticks. In the retracted position, expandable batons can be worn in a holster attached to the equipment belt of a law enforcement officer without interfering with the movement of the officer. Additionally, when retracted, the expandable baton can be somewhat concealed by the officer to reduce his or her threatening appearance when confronted with a delicate situation.

Expandable batons typically include an outer gripping tube that acts as the handle for the baton when the baton is in the extended position. One or two telescoping sections nest within the gripping tube such that the retracted length of the expandable baton is approximately one-third of its extended length. During use, the baton is sharply swung in an arc such that the inner telescoping sections are flung outward by the centrifugal force generated during the swinging action. Typically, each of the telescoping sections include an expanded end that interacts with a tapered surface formed on the outer section to frictionally lock the baton in its extended position.

Although currently available expandable batons work reasonably well, improvements may be made to enhance their capability and efficiency. When a law enforcement officer attempts to restrain an individual through a swinging action of the baton, the amount of force associated with the swing is attributable to the centrifugal force generated at the striking end of the baton. Thus, the greater the weight of the baton and the longer the baton, the greater the force that may be imparted. Notwithstanding that current expandable batons have permitted an increase in inertia provided by weapon use in a swinging fashion, there remains a need to provide for a customized design in which an officer may selectively change the weight and strike force capability of the expandable baton. It is also desirable to upgrade the handling of the baton so that it can be accessed more easily from one's holster and can be positively grasped to provide a reliable intermediate force weapon for the officer. Furthermore, it is desirable to offer an expandable baton in which the telescoping sections may be extended at variable rates and lengths as desired by the individual user.

SUMMARY OF THE INVENTION

It is a general object of the present invention to provide an expandable baton which provides improved strike force capability, handling and operating efficiency for law enforcement personnel.

It is one object of the present invention to provide a variable weight expandable baton in which removable slugs are slidably inserted inside the striking tube of the baton.

It is also an object of the present invention to provide an expandable baton having an upgraded gripping structure on the gripping tube of the baton.

It is a further object of the present invention to provide an expandable baton having an adjustable closure cap and force retention arrangement on the gripping tube for variably changing the rate in which the baton is moved from the retracted position to the extended position.

It is an additional object of the present invention to provide an expandable baton in which the length of the striking tube may be increased.

In one aspect of the invention, a self defense tool has a tubular body provided with an axial bore and a removable closed handle end opposite a removable closed striking end. The invention is improved by a variable weight holding arrangement positioned inside the axial bore of the body between the handle and the striking ends and engageable with the striking end. The holding arrangement is adapted to retain at least one weight member inside the axial bore to selectively enable changing weight of the tool. The variable weight holding arrangement is accessible from at least the striking end. The variable weight holding arrangement includes a stop disposed in the axial bore of the body, a coil spring inserted in the axial bore and extending between the stop and the striking end, and the at least one weight member being adapted to be received in the axial bore and held between the spring and the striking end. The stop is a set screw threadably received in the axial bore of the body. The spring has a first end engaged with the set screw, and a second end normally engaged with the striking end, and adapted to be engaged with the at least one weight member. Upon removal of the striking end, the spring will urge the at least one weight member out of the tubular body.

In another aspect of the invention, a variable weight baton is expandable between a retracted position and an extended position. The baton includes a gripping tube having an outer wall and an inner wall defining an axial bore extending between a first end and a second end provided with a removable end cap. A striking tube is telescopingly slidable into and out of the axial bore of the gripping tube. The striking tube has an external wall and an internal wall defining an axial passageway extending between a first end provided with a removable end cap and a second end slidably received in the first end of the gripping tube. The striking tube includes a stop positioned in the axial passageway, a spring extending between the stop and the end cap, and at least one weight member disposed between the spring and the end cap for selectively enabling changing weight of the baton. In the retracted position, the striking tube is retained within the gripping tube by a resilient member which forms a retention force. The gripping tube includes adjustment structure for changing the retention force between the gripping tube and the striking tube. The spring extends along a substantial length of the axial passageway of the striking tube. An external surface of the gripping tube is provided with a non-slip, resilient gripping member formed with a plurality of grip-enhancing holes.

In yet another aspect of the invention, a variable weight baton is expandable between a retracted position and an extended position. The baton includes a gripping tube having an outer wall and an inner wall defining an axial bore extending between a first end and a second end provided with a closure cap. A center tube is telescopingly slidable into and out of the axial bore of the gripping tube. The center tube has an exterior wall and an interior wall defining an axial chamber extending between a first end and a second end. A striking tube is telescopingly slidable into and out of the axial chamber of the center tube. The striking tube has an external wall and an internal wall defining an axial passageway extending between a first end provided with an end cap, and a second end slidably received in the first end of the center tube. The striking tube includes a stop positioned in the axial passageway, a spring extending between the stop and the end cap, and a weight arrangement disposed between the spring and the end cap for selectively enabling changing weight of the baton. The stop is a set screw threadably received in the axial passageway of the striking tube. The spring has a first end engaged with the set screw, and a second end engaged against the weight arrangement. In one embodiment, the weight arrangement is comprised of a single removable weight member slidably insertable into and out of the axial passageway of the striking tube. In another embodiment, the weight arrangement is comprised of a series of adjacently disposed, removable weight members. Each weight member preferably is a bullet-shaped slug having a flat rear end and a curved front end. Each rear end is recessed to receive a curved front end of an adjacently disposed weight member. The closure cap may be provided with an external knurled surface to enhance handling of the baton.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figures 1, 2, 6:
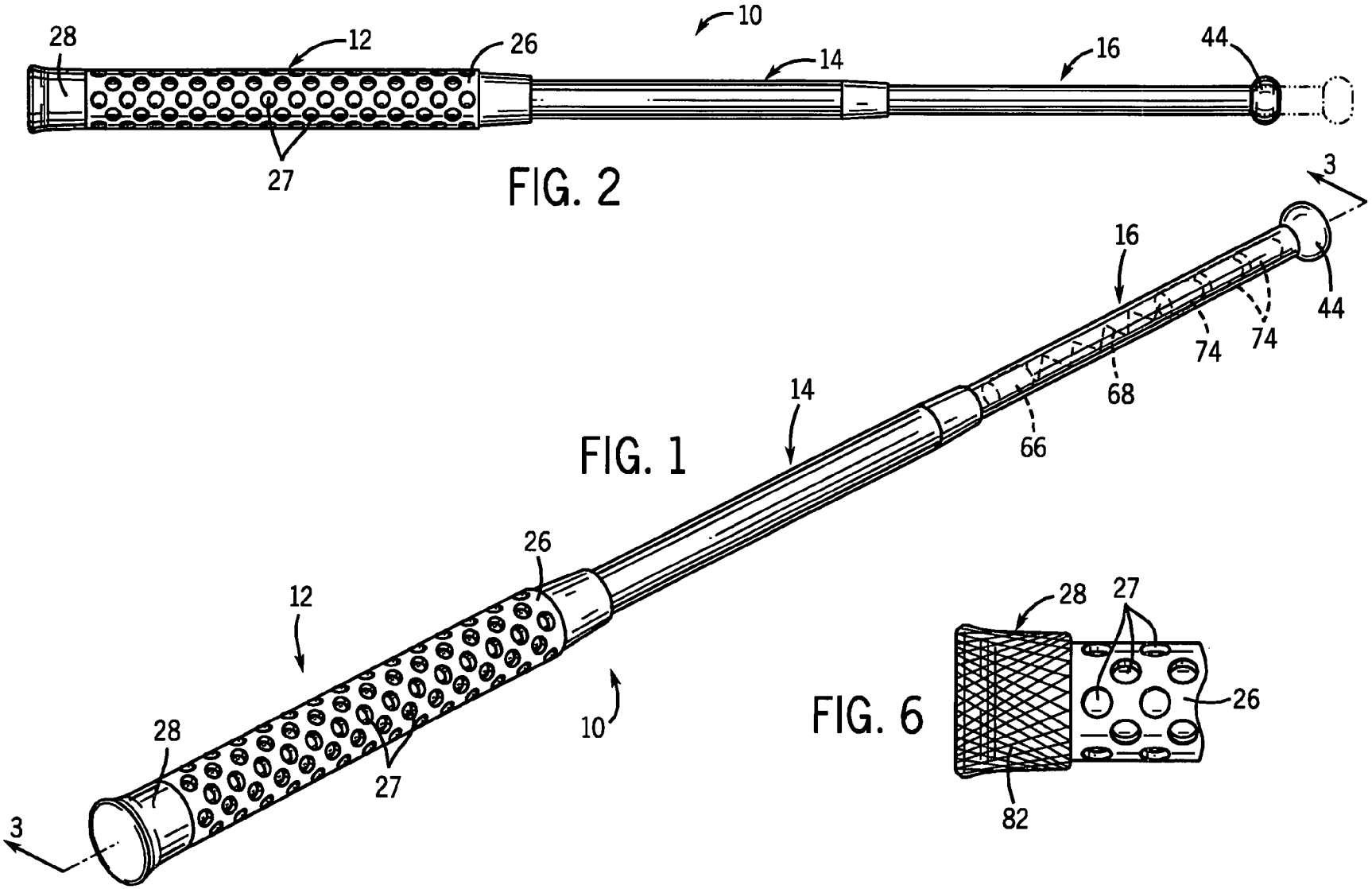
FIG. 1 is a perspective view of a variable weight expandable baton of the present invention in an extended position.
FIG. 2 is a elevational view of the baton shown in FIG. 1.
FIG. 6 is an enlarged view of an alternative closure cap which may be used on the handle end of the baton.

Referring now to the drawings, FIGS. 1 and 2 generally illustrate a variable weight, expandable baton 10 of the present invention. The baton 10 is expandable between the retracted position shown in FIGS. 5 and 5A and the extended, operative position shown in FIGS. 1, 2, 2A, 3 and 4.

Figure 5:
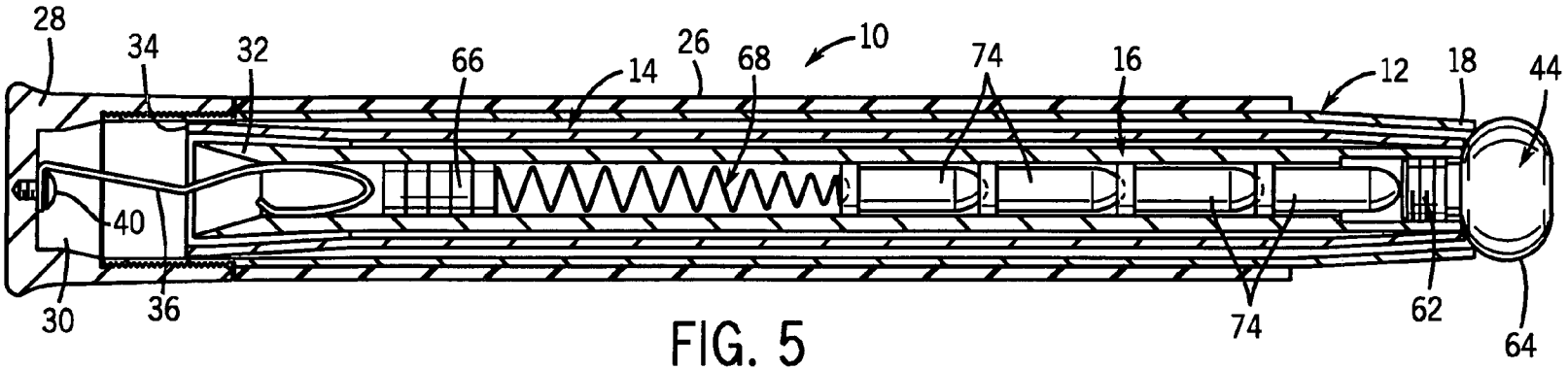
FIG. 5 is a sectional view of the baton of FIG. 4 in a retracted position.
Figure 5A:
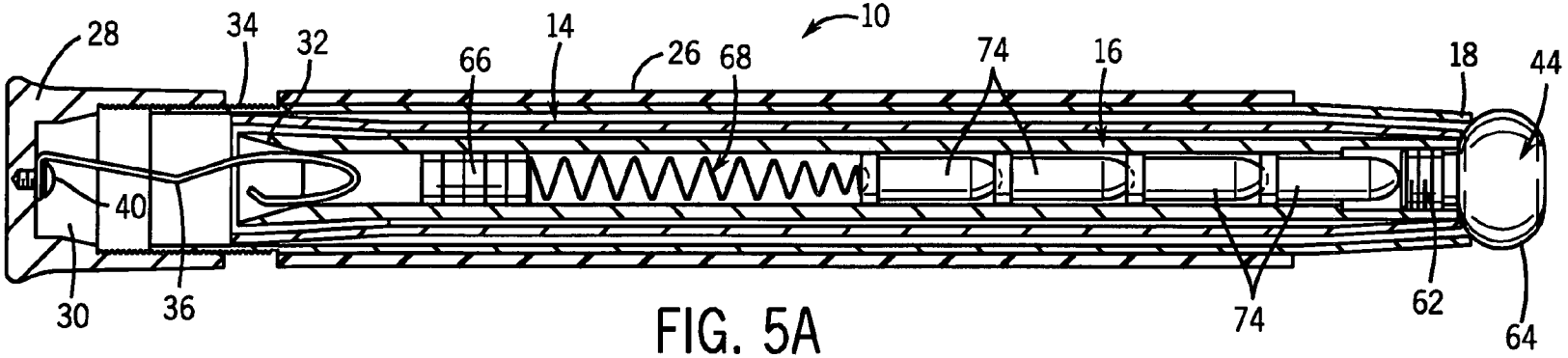
FIG. 5A is a view similar to FIG. 5 showing the closure cap adjusted to change the retention force of the baton in the retracted position.

The baton 10 generally includes a gripping tube 12, a center tube 14 and a striking tube 16. The gripping tube 12 extends longitudinally between a first end 18 and a second end 20 and includes an outer wall 21 and inner wall 22 that defines an axial bore 23. The axial bore 23 formed in the gripping tube 12 is sized to receive the center tube 14 and the striking tube 16 in a nested fashion as seen in FIGS. 5 and 5A. Specifically, an external wall 17 of the striking tube 16 is received within an axial chamber 24 formed in the center tube 14, and an exterior wall 15 of the center tube 14 is received in the axial bore 23. A resilient, non-slip grip member 26, such as constructed from a rubber material, is adhered to the outer circumference of the gripping tube 12. The grip member 26 is provided with a series of spaced apart holes 27 to improve retention of the baton 10 in the hands of its user, and to enhance the aesthetics of the baton 10.

In the preferred embodiment of the invention, a closure cap 28 is threadably attached to the second end 20 of the gripping tube 12. The closure cap 28 includes a well 30 that opens into the axial bore 23 which is sized large enough to receive a second end 32 of the striking tube 16 and a second end 34 of the center tube 14 when the baton 10 is in the retracted position. A resilient wire retainer 36 is attached to a bottom wall 38 of the well 30 by a fastener 40. The wire retainer 36 extends from the closure cap 28 into the axial bore 23 and is compressed into contact with an internal wall 42 of striking tube 16 when the baton 10 is in the retracted position. The interaction between the wire retainer 36 and the internal wall 42 of the striking tube 16 exerts a retention force to hold the tubes of the baton 10 in the retracted position. To extend the baton 10, an outward force must be applied to the striking tube 16 to overcome the retention force created by wire retainer 36. The outward force can be created by either swinging the baton 10 in an arc to generate a centrifugal force, or by grasping a bulbous end cap 44 on a first end 45 of striking tube 16 and pulling the striking tube 16 from within the axial bore 23.

As a feature of the invention illustrated in FIG. 5A, the closure cap 28 may be unscrewed several threads from the second end 20 of gripping tube 12 to lessen the maximum frictional force exerted by the wire retainer 36 relative to internal wall 42 of striking tube 16 as shown in FIG. 5. This selective adjustment has the effect of permitting the baton 10 to be whipped out into the extended position at variable rates.

Figure 2A:
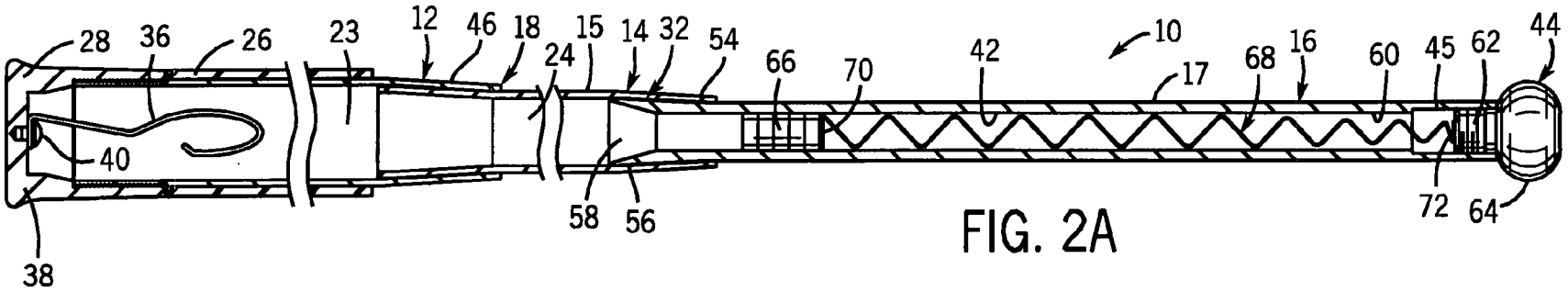
FIG. 2A is a sectional view of FIG. 2 showing the baton without any weight member added inside the baton.
Figure 3:
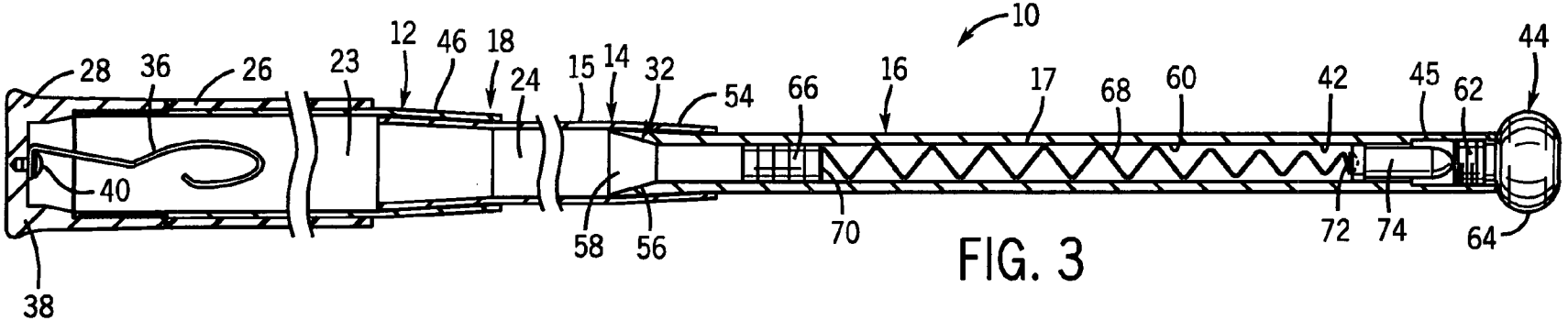
FIG. 3 is a sectional view taken on line 3—3 of FIG. 2 showing the use of a single weighted member inside the striking tube of the baton.
Figure 4:
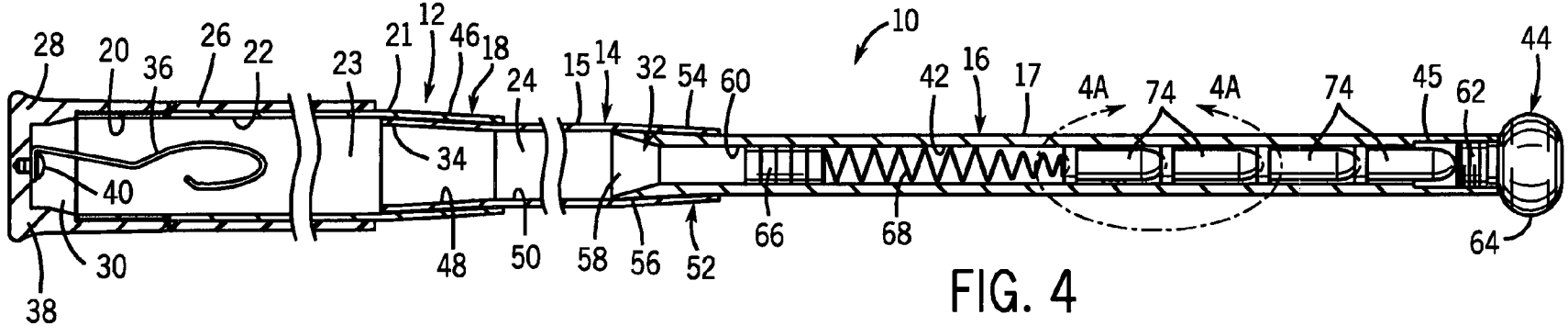
FIG. 4 is a view similar to FIG. 3 showing multiple weighted members inside the striking tube of the baton.

As seen in FIGS. 2A, 3 and 4, the first end 18 of gripping tube 12 includes a tapered portion 46 having an inner diameter which gradually decreases from the inner diameter of axial bore 23. The second end 34 of the center tube 14 also includes a tapered portion 48 which increases in diameter from the diameter of an interior wall 50 defining axial chamber 24. When the baton 10 is in the extended position, the increasing diameter of portion 48 on center tube 14 interacts with the decreasing tapered portion 46 formed on first end 18 of gripping tube 12. The frictional engagement between these two members holds the center tube 14 and gripping tube 12 in their extended positions.

A first end 52 of the center tube 14 includes a decreasing diameter tapered portion 54 having a diameter which is slightly reduced from the diameter of interior wall 50. An increasing diameter tapered portion 56 is contained on second end 32 of striking tube 16. When the baton 10 is in the extended position, the increasing diameter portion 56 on striking tube interacts with the decreasing diameter tapered portion 54 formed on first end 52 of center tube 14. The frictional engagement between these two members holds the center tube 14 and the striking tube 16 in their extended positions. An expanded guide bore 58 is formed on the second end 32 of striking tube 16 in alignment with an axial passageway 60 defined by the inner wall 42. The guide bore 58 aids in guiding the wire retainer 36 into the striking tube 16 when the baton 10 is moved to the retracted position as shown in FIGS. 5 and 5A. The first end 45 of striking tube 16 is internally threaded to receive an externally threaded attachment shank 62 of end cap 44 which has a striking portion 64. The end cap 44 has a bulbous contour which is designed not to cause puncture wounds if the retracted baton 10 is used to poke or prod a suspect. The threaded engagement between the attachment shank 62 and the striking tube 16 allows the end cap 44 to be removed from the striking tube 16, if desired.

In accordance with the invention, the striking tube 16 is provided with a variable weight holding arrangement positioned in axial passageway 60 between the first end 45 and the second end 32 to selectively enable changing the weight of the baton 10.

Referring to FIG. 2A, the striking tube 16 is internally threaded to threadably receive a stop in the form of a set screw 66 near the second end 32. An elongated coil spring 68 is slidably inserted in the axial passageway 60 by removing end cap 44. The spring 68 has a first end 70 engaged against an end of the set screw 66 facing end cap 44. A second end 72 of spring 68 is engaged against the end of the attachment shank 62 of end cap 44 when end cap 44 is threaded back into striking tube 16. The set screw 66 and the spring 68 define the holding arrangement for slidably receiving and retaining one or more removable weight members 74 inside the axial passageway 60. In FIG. 2A, the striking tube 16 is not provided with any weight member 74.

Figure 4A:
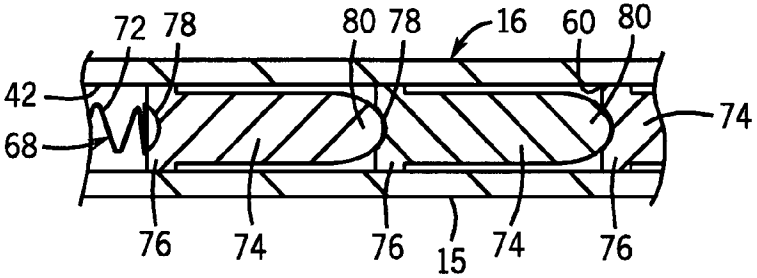
FIG. 4A is an enlarged detailed view taken on line 4A—4A of FIG. 4.

In FIG. 3, the striking tube 16 is provided with a single weight member 74 to slightly increase the weight of the baton 10. FIG. 4 shows the striking tube 16 equipped with a series of adjacently disposed weight members 74 disposed between spring 68 and attachment shank 62. In the preferred embodiment shown in FIG. 4A, the weight members 74 are bullet-shaped slugs with the back end 76 of each slug 74 being recessed or countersunk at 78 to receive a nose 80 of an adjacently disposed slug 74 so as to ensure alignment of the slugs 74 and prevent any rattling. The back end 76 of each weight slug 74 has a diameter slightly less than the diameter of axial passageway 60 so that each weight slug 74 slides cleanly into the striking tube internal wall 42. The overall weight of the striking tube 16 can thus be modified by selectively inserting or removing the weight slugs 74. In this manner, the baton can be modified by the owner. The spring 68 is designed so that upon removal of the end cap 44, the weight slugs 74 will be expelled from the open end 45. It may also be possible to further use variably weighted end caps 44 to selectively change the weight of the baton 10. Increasing the weight of the baton 10 will enable the user to exert a greater striking force in use.

The invention contemplates providing a striking tube 16 with longer lengths if desired as represented by the phantom lines in FIG. 2. Likewise, the gripping tube and the center tube may have variable lengths. In addition, it should be understood that closure cap 28 may be provided with a knurled surface 82 and a diameter greater than the diameter of the grip member 26, as shown in FIG. 6, to prevent slippage from the user's hand. Also, it should be appreciated that the gripping tube 12, center tube 14 and striking tube 16 may be formed of various rigid materials having various wall thicknesses to provide the requisite strength of the baton 10.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. In a self defense tool having a tubular body provided with an axial bore and a removable closed handle end opposite a removable closed striking end, the improvement comprising:

a variable weight holding arrangement positioned inside the axial bore of the body between the handle and striking ends and engageable with the striking end, the holding arrangement being adapted to retain at least one weight member inside the axial tube to selectively enable changing the weight of the tool, wherein the variable weight holding arrangement includes a stop disposed in the axial bore of the body, a coil spring inserted in the axial bore and extending between the stop end and the striking end, and the at least one weight member being adapted to be received in the axial bore and held between the spring and the striking end, and wherein the stop is a set screw threadably received in the axial bore of the body.

2. The improvement of claim 1, wherein the variable weight holding arrangement is accessible from at least the striking end.

3. The improvement of claims 1, wherein the spring has a first end engaged with the set screw, and a second end normally engaged with the striking end and adapted to be engaged with the at least one weight member whereupon removal of the striking end, the spring will urge the at least one weight member out of the tubular body.

4. A variable weight baton expandable between a retracted position and an extended position, the baton comprising:

a gripping tube having an outer wall and an inner wall defining an axial bore extending between a first end and a second end provided with a removable closure cap;

a striking tube telescopingly slidable into and out of the axial bore of the gripping tube, the striking tube having an external wall and an internal wall defining an axial passageway extending between a first end provided with a removable end cap and a second end slidably received in the first end of the gripping tube, wherein the striking tube includes an adjustable stop positioned in the axial passageway;

a spring extending between the stop and the end cap; and at least one weight member disposed in the axial passageway of the striking tube between the spring and the end cap for selectively enabling changing the weight of the baton.

5. The baton of claim 4, wherein, in the retracted position, the striking tube is retained within the gripping tube by a resilient member which forms a retention force.

6. The baton of claim 5, wherein the gripping tube includes adjustment structure for changing the retention force between the gripping tube and the striking tube.

7. The baton of claim 4, wherein the spring extends along a substantial length of the axial passageway of the striking tube.

8. The baton of claim 4, wherein an external surface of the gripping tube is provided with a non-slip, resilient gripping member formed with a plurality of spaced apart, grip-enhancing holes.

9. The baton of claim 4, further comprising a plurality of weight members selectively disposed in the axial passageway of the striking tube for selectively changing the weight of the baton.

10. A variable weight baton expandable between a retracted position and an extended position, the baton comprising:

a gripping tube having an outer wall and an inner wall defining an axial bore extending between a first end and a second end provided with a closure cap;

a center tube telescopingly slidable into and out of the axial bore of the gripping tube, the center tube having an exterior wall and an interior wall defining an axial chamber extending between a first end and a second end;

a striking tube telescopingly slidable into and out of the axial chamber of the center tube, the striking tube having an external wall and an internal wall defining an axial passageway extending between a first end provided with an end cap and a second end slidably received in the first end of the center tube, wherein the striking tube includes a stop positioned in the axial passageway;

a spring extending between the stop and the end cap; and a weight arrangement disposed between the spring and the end cap for selectively enabling changing the weight of the baton, wherein the stop is a set screw threadably received in the axial passageway of the striking tube.

11. The baton of claim 10, wherein the spring has a first end engaged with the set screw, and a second end engaged against the weight arrangement.

12. The baton of claim 10, wherein the weight arrangement is comprised of at least one removable weight member slidably insertable into and out of the axial passageway of the striking tube.

13. The baton of claim 12, wherein the at least one weight member is a bullet-shaped slug.

14. The baton of claim 10, wherein the weight arrangement is comprised of a series of adjacently disposed, removable weight members.

15. The baton of claim 14, wherein each of the weight members has a flat rear end and a curved front end, each rear end being recessed to receive a curved front end of an adjacently disposed weight member.

16. The baton of claim 10, wherein the closure cap is provided with an external knurled surface.

* * * * *

UNITED STATES PATENT AND TRADEMARK OFFICE

CERTIFICATE OF CORRECTION

PATENT NO. : 7,044,858 B1
APPLICATION NO. : 11/033857
DATED : May 16, 2006
INVENTOR(S) : Otto et al.

It is certified that error appears in the above-identified patent and that said Letters Patent is hereby corrected as shown below:

In claim 3, Line 24, delete “claims” and insert --claim--.

Signed and Sealed this

Fifteenth Day of August, 2006

JON W. DUDAS
*Director of the United States Patent and Trademark Office*